US006080035A

United States Patent [19]

Pekarsky et al.

[11] Patent Number: 6,080,035

[45] Date of Patent: Jun. 27, 2000

[54] YO-YO HAVING SNAP-ON ROTOR MEMBERS

[75] Inventors: Henry Pekarsky; Friedrich Weber, both of Karlsruhe, Germany

[73] Assignee: Henrys Jonglierbedarf, Germany

[21] Appl. No.: 09/013,824

[22] Filed: Jan. 27, 1998

[30] Foreign Application Priority Data

Jul. 19, 1997 [DE] Germany ..... 297 12 814 U

[51] Int. Cl.[7] ..... A63H 1/30

[52] U.S. Cl. ..... 446/250

[58] Field of Search ..... 446/250, 251, 446/252, 249, 248, 247, 255

[56] References Cited

U.S. PATENT DOCUMENTS

| | | | |
|---|---|---|---|
| 2,463,670 | 3/1949 | Yankelevitz . | |
| 2,579,022 | 12/1951 | Spencer et al. . | |
| 2,891,351 | 6/1959 | Madaras et al. . | |
| 3,093,926 | 6/1963 | Wright | 446/255 |
| 3,175,326 | 3/1965 | Isaacson | 446/250 |
| 3,653,148 | 4/1972 | Finkel | 466/255 |
| 4,207,701 | 6/1980 | Kuhn . | |
| 4,895,547 | 1/1990 | Amaral | 446/250 |
| 5,100,361 | 3/1992 | Kuhn et al. . | |

FOREIGN PATENT DOCUMENTS

| | | | |
|---|---|---|---|
| 2200853 | 8/1988 | United Kingdom | 446/250 |

*Primary Examiner*—D. Neal Muir
*Attorney, Agent, or Firm*—Chadbourne & Parke LLP

[57] ABSTRACT

A climbing top has two shells connected by an axle assembly, wherein at least one of the shells comprises a hub member receiving the axle assembly and a rotor member extending radially outwardly of the hub member with respect to the axle assembly. The rotor member is mounted on the hub member with a direct snap-on connection which prevents axially outward displacement of the rotor member with respect to the hub member.

23 Claims, 7 Drawing Sheets

YO-YO HAVING SNAP-ON ROTOR MEMBERS

BACKGROUND OF THE INVENTION

The invention concerns a climbing top, in particular a yo-yo. A climbing top comprises two shells functioning as a rotor member between which the climbing or pulling string is guided. The shells are connected via an axle, wherein the axle is part of one or both of the shells or can be made from one or more separate axle components. The invention is described below, without limitation in generality, with reference to a yo-yo.

In conventional yo-yos up to this point in time each of the two shells has been a single piece, for example an extruded component, a component made from wood, or from aluminum. This type of construction has the advantage that assembly of the yo-yo is relatively easy, since the yo-yo is assembled from a low number of individual components. The conventional single component embodiment for the shells has however the disadvantage that, with regard to the selection of materials, a compromise must be made between contradictory requirements. The material must, on the one hand, be sufficiently strong and hard to have sufficient stability in the central region to mount the axle, usually via a thread. On the other hand, the material should not be too heavy in order to keep the overall weight of the yo-yo low and should have a certain degree of elasticity so that the shell is somewhat flexible. Flexibility is necessary so that, when the yo-yo strikes the floor, it does not suffer any permanent deformation or, in the event of rapid return into the hand, does not cause a painful blow. It has not been possible up to this point in time to configure the shells of conventional yo-yos with sufficient elasticity in this regard.

With conventional yo-yos, one either chooses a material for the shells that satisfies one of the two contradictory requirements and accepts the disadvantages with regard to the other aspect, or one chooses a material which is at least to a certain extent a compromise between the two requirements. This latter possibility has however disadvantages. The precision of the bearing and the overall construction is not optimized due to the low degree of strength of the components forming the mounting. Also the resistance to wear and the overall lifetime of the yo-yo are thereby compromised.

SUMMARY OF THE INVENTION

Taking into account this prior art, it is the underlying purpose of the invention to further improve the conventional climbing top, in particular yo-yo, in such a fashion that the above mentioned disadvantages of the conventional yo-yo are avoided, wherein simple assembly of the yo-yo is simultaneously guaranteed.

The solution in accordance with the convention, with a climbing top, in particular a yo-yo, having two shells connected to each other by means of an axle, provides that at least one of the shells comprises a hub member for accepting the axle and a rotor member extending, relative to the hub member, in a radially more outward direction and mounted, by means of a latch connection, to the hub member and secured against an axially outward displacement.

Within the context of the invention, an axial direction is defined as a direction along the axle or rotational axis of the yo-yo. Outwardly directed is defined as a direction away from the roller and inwards towards the roller. The radial direction extends perpendicular to the axle or rotational axis of the yo-yo.

The two part configuration, in accordance with the invention, of at least one shell preferentially both shells, allows for use of optimal materials for each of the hub member and the rotor member respectively. The latch connection facilitates a simple mounting of the hub member and the rotor member, wherein the rotor member is secured with respect to an axially outward displacement, i. e. against detachment from the hub member.

The pulling string can, in simple embodiments, be securely mounted to the shells, for example by means of clamping. Climbing tops are preferred having a roller borne by the axle and disposed between the shells to which the pulling string is attached or which rolls on the climbing string. The roller can preferentially be freely rotated, for example, by means of a ball bearing.

In accordance with an additional advantageous feature, a seating surface for the rotor member is formed in the hub member to secure the rotor member with respect to axially inward displacement. In this manner, the rotor member can be axially secured on the hub member.

With an additional advantageous feature, the rotor member is secured with respect to rotation relative to the hub member at least for forces which occur during use of the yo-yo. Towards this end use can be made of conventional gear shaped structures or rod members engaging in corresponding openings or grooves. A particularly advantageous feature proposes securing the rotor member with respect to rotation by clamping same between the latch connection and the seating surface using frictional forces. This configuration is particularly simple to manufacture.

The hub member can advantageously consist essentially of metal, since metal has a high degree of strength. In order for the yo-yo to be light weight, it is thereby advantageous for the hub member to consist essentially of a light metal, for example, aluminum. In other advantageous embodiments, the hub member can be made from plastic, preferentially from hard plastic. It is thereby also possible to use different plastics for the hub member and the rotor member.

The rotor member is advantageously manufactured from a resilient elastic material having a high restoring force, the modulus of elasticity of which lies between 1 and 500, preferentially between 10 and 200 and particularly preferentially between 30 and 100 MPa. The rotor member should not be too hard so that, if the yo-yo strikes the floor, no permanent deformation of the components occurs. The elastic rotor member causes a reduction in the maximum load on the axle when the floor is struck. An elastic, flexible rotor member is also advantageous, since rapid return of the yo-yo into the hand of the user does not thereby cause a blow to the hand. The rotor member should however not be too flexible so that sufficient stability is achieved and the intrinsic vibration of the yo-yo is kept small.

An additional advantageous structural feature is the composition of the rotor member from a material having small creeping behavior whose modulus of creeping lies between 3 and 300 MPa. This value is with regard to the normal temperature during use as well as a load time between 0.1 hours and 10,000 hours. Use of a modulus of creeping with these values guarantees that the material has sufficient intrinsic strength.

Plastics, in particular thermoplastic elastomers, have turned out to be particularly advantageous low weight materials for the rotor member. In addition, silicon has turned out to be a particularly advantageous material.

In order for the rotor member not to rotate relative to the hub member during use of the yo-yo, the rotor member advantageously consists essentially of a material having high friction, the coefficient of friction of which on the material of the hub member is larger than 0.1 and preferentially larger than 0.2. In this case it is possible, through frictional forces alone, which e. g. are produced by clamping or tightening, to secure the rotor member onto the hub member in a manner in which it is secured against rotation in normal use.

A particularly advantageous feature proposes that the rotor member, in an initial shape which is equivalent to the shape during use, is curved in a concave manner in the axial direction and has a central opening for placement onto the hub member and is flexible and elastic in such a manner that it can be flipped over into a convex shape for placement onto the hub member. It can then be placed in the convex shape onto the hub member and, at this location, be flipped over into the concave shape, i. e. flipped back into the initial shape while effecting a latching connection between the hub member and the rotor member, particularly the edge of the central opening, for mounting onto the hub member. This configuration has advantages with respect to particularly simple assembly and with regard to the strength of the latch connection. The flipping over of the rotor member allows for the diameter of the central opening to be increased. In the flipped over shape, the rotor member can then be placed onto the hub member, either from the inside or from the outside, and be flipped back into the concave shape. In this fashion, the central opening is reduced as a result of which a large holding force for the rotor member on the hub member is achieved.

The invention provides a yo-yo which has a low weight, which is simple to assemble, which functions for a long period of time and which runs very smoothly. In addition, the yo-yo in accordance with the invention is relatively insensitive with respect to blows on the floor and comfortable for the user's hand.

The following embodiments of the invention facilitate recognition of additional advantageous features and characteristics which, with regard to the schematic representation of the drawing, are further described and explained below.

DETAILED DESCRIPTION OF THE INVENTION

Figure 1:
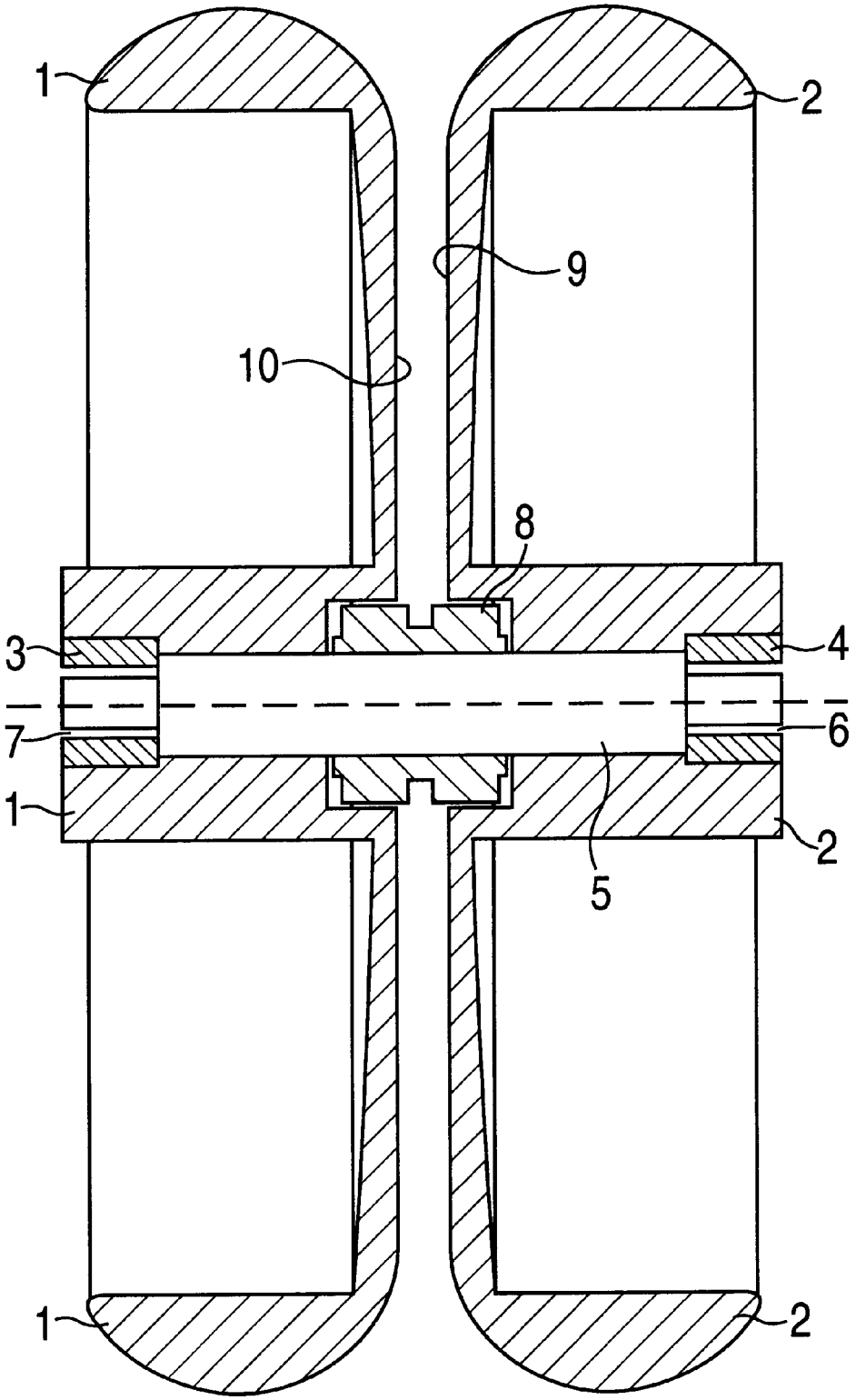
FIG. 1 PRIOR ART
FIG. 1 shows a cross section through a yo-yo according to prior art.

FIG. 1 shows a yo-yo according to prior art. It comprises a first shell 1 and a second shell 2. The shells 1, 2 are each made from a single piece and each consists essentially of a uniform material, for example wood, aluminum or plastic. The wall thickness of the shells 1 and 2 is increased in the hub region in order to be able to accept forces occurring therein. Insert nuts 3, 4, having an inner thread 6, 7, are pressed into each of the axially outward disposed ends of the shell 1, 2. The two shells 1, 2 are connected by an axle 5 which is firmly screwed into both the threads 6, 7 at both its ends. The length of the axle 5 determines the fixed separation between the shells 1, 2.

The axle 5 bears a roller 8 disposed between the shells 1, 2 onto which the pulling string (not shown) is attached. The roller 8 is borne with a small amount of play in a freely rotatable fashion on the axle 5. In high quality embodiments, a rolling bearing, for example a ball bearing or a pin bearing can be utilized. The guiding surfaces 9, 10 in the shells 1, 2 can be parallel to each other, as in the embodiment shown, or subtend a small conical angle of e. g. 2°.

Figure 2:
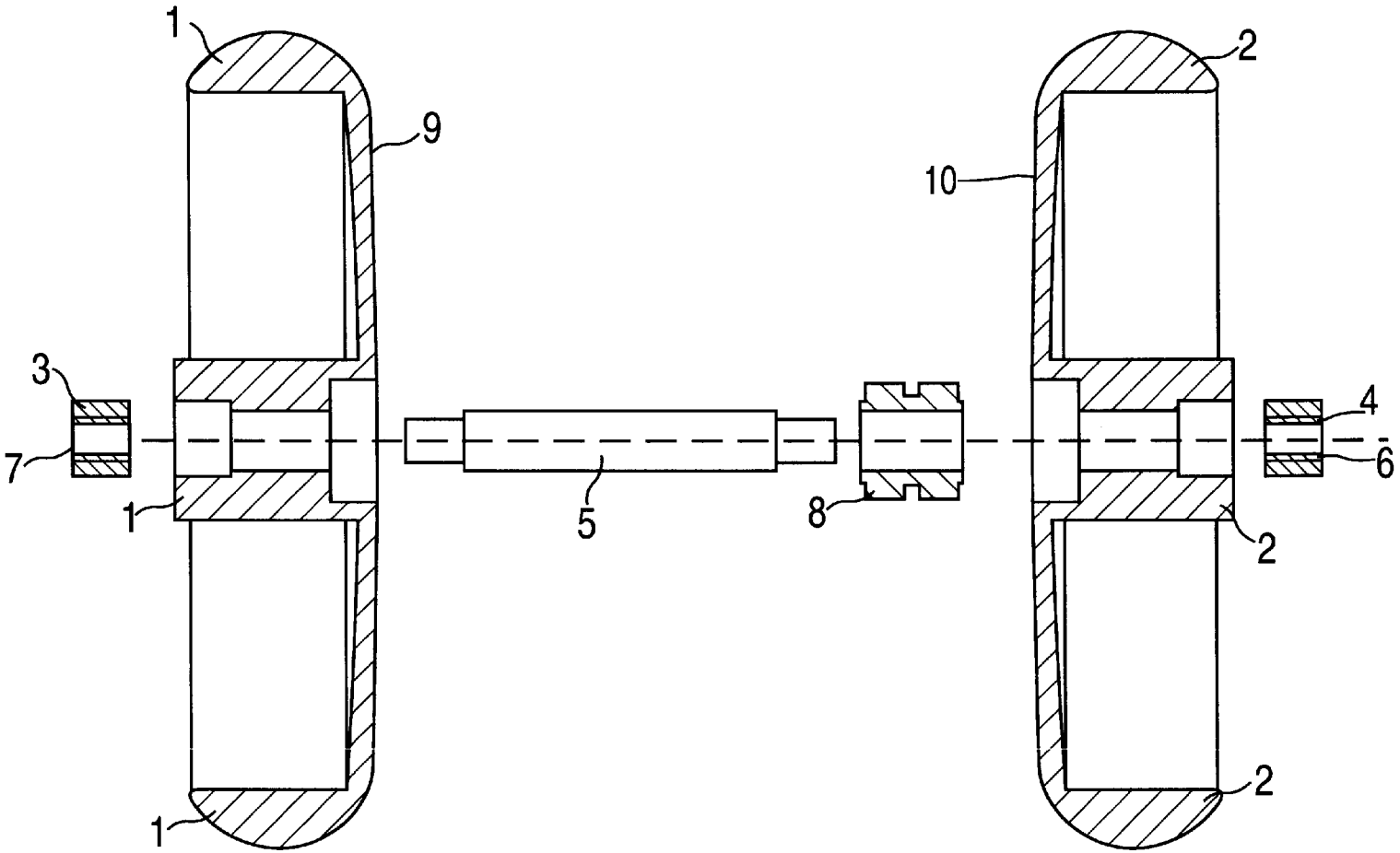
FIG. 2 PRIOR ART
FIG. 2 shows the yo-yo of FIG. 1 in the disassembled state.

FIG. 2 shows the individual parts of the yo-yo. In order to assemble the yo-yo, the two insert nuts 3, 4 are pressed into their respective shells 1, 2. For this reason, despite the increased wall thickness of the shells 1, 2 in this region, the shells 1, 2 must be made from a strong, relatively inflexible material. In order to continue assembly of the yo-yo, the axle 5 is initially screwed into one of the two insert nuts 3, 4 and the roller 8 is subsequently placed over the axle 5. The second shell is then screwed onto the free end of the axle.

Figure 3:
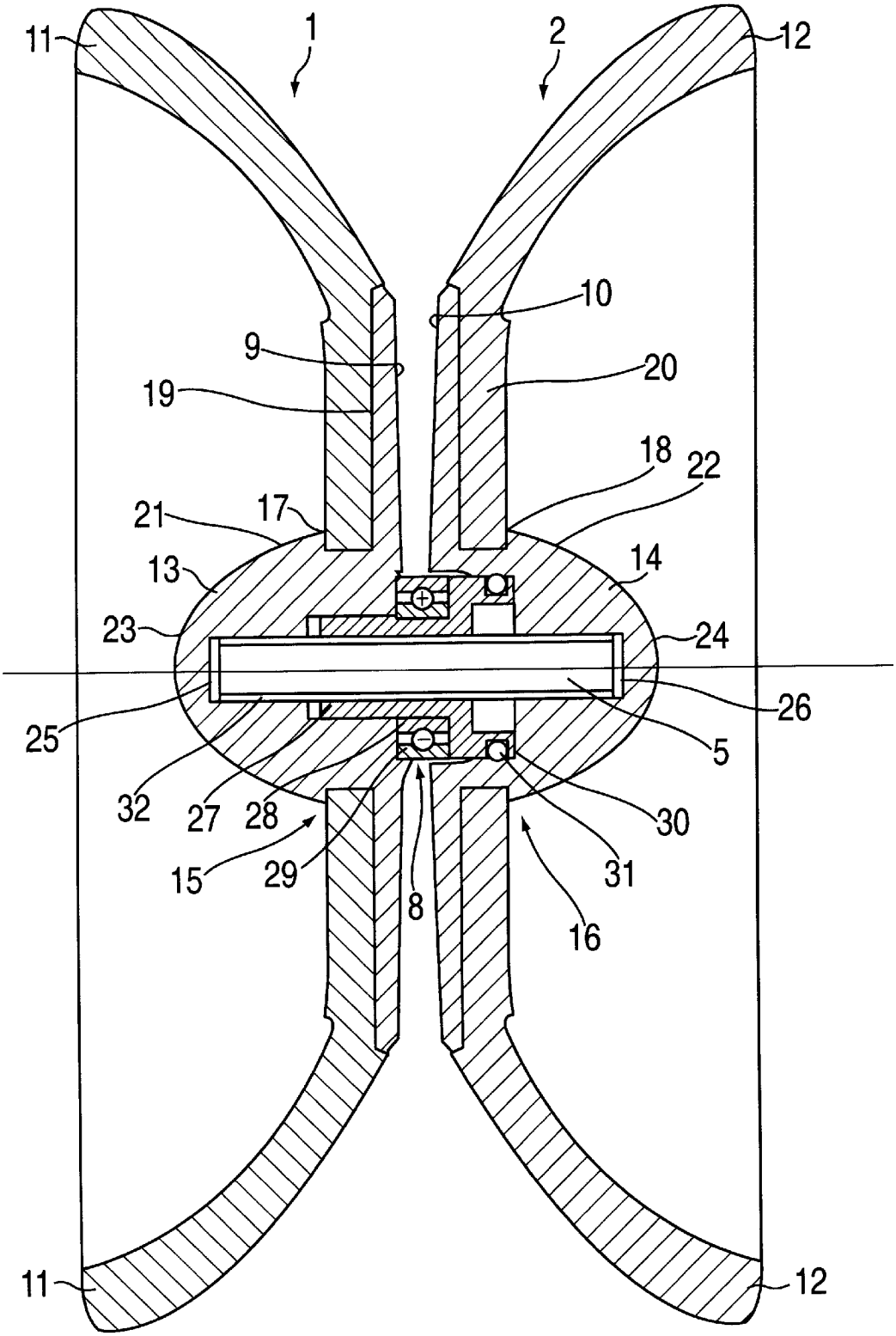
FIG. 3 shows a cross section through a yo-yo in accordance with the invention.

FIG. 3 shows a cross section through a yo-yo in accordance with the invention. It has the special characteristic that each of the shells 1, 2 comprises two parts manufactured from differing materials. The shells 1, 2 each comprise a hub member 13, 14 for the acceptance of the axle 5 and a rotor member 11, 12. The rotor members 11, 12 extend radially beyond the hub members 13, 14 and are mounted to the hub members 13, 14 by means of a latch connection 15, 16 by means of which they are secured against an axially outward displacement. The hub members 13, 14 additionally form inwardly disposed seating surfaces 19, 20 for the rotor members 11, 12 to secure the rotor members 11, 12 against axially inward displacement. The rotor members 11, 12 are clamped, by frictional forces and in a rotationally secure fashion, between the latch connections 15, 16 disposed axially outward from the rotor members 11, 12 and the axially inner seating surfaces 19, 20.

The latch connections 15, 16 have latch edges 17, 18, the axially outward section of which is tapered towards the axle 5. During assembly of the shells 1, 2, by joining the respective rotor member 11, 12 with the associated hub member 13, 14, the hub member 13, 14 can thereby be passed through the middle opening of the rotor member 11, 12, wherein the rotor member 11, 12 is somewhat stretched and the opening diameter enlarged. The stretched opening in the rotor member 11, 12 then slides over the latch edge 17, 18 wherein, at this point in time, the maximum opening width is achieved. When the hub member 13, 14 is pushed through the rotor member 11, 12, the opening in the shell member 11, 12 is reduced due to its intrinsic elasticity so that the shell member 11, 12 snaps in behind the latch connection 15, 16 or the latch edge 17, 18 on the hub member 13, 14. It is held on the hub member 13, 14 in this position by the latch edge 17, 18, since the radially outer diameter D1 of the snapping edge 17, 18 is somewhat larger than the inner diameter D2 of the corresponding central opening formed in the rotor member 11, 12.

The latch edge 17, 18 advantageously extends, at least over a section, in a ring-shaped fashion about the axle 5 and preferentially forms a circular ring. An alternate embodiment of the latch connection 15, 16 (not shown) could provide for the latch connection 15, 16 to be effected by at least one latch edge 17, 18 on the hub member 13, 14 formed on at least one rod member penetrating through an associated opening in the rotor member 11, 12 and disposed on the axially outer end of the rod member. In other words it is possible for the snapping edge to be formed on a rod member which penetrates through the rotor member 1, 2 at a position radially inward of which, shell member 11, 12 material is present. In this case, the rod member does not penetrate through a central opening rather through an opening or bore hole in the shell member 11, 12 disposed more radially outward.

An additional particular feature of the yo-yo shown provides that the hub members 13, 14 have a rounded cap 23, 24 in the vicinity of the axle 5. In this manner, an esthetically attractive form is achieved for the yo-yo and the roller 11 is protected from sideward soiling. The axle 5 is disposed in bottom holes 25, 26. A support bushing 27 is screwed into the first shell member 11 and holds the inner ring 28 of the bearing associated with the roller 8. The outer ring 29 of the roller 8 is freely rotatable and borne by ball bearings. The end of the axle 5 facing the first shell 1 is pushed through the support bushing 27 and is screwed, via a thread, into the thread in the bottom hole of the hub member 13. The end of the axle 5 facing the second shell is screwed, via a thread, into the bottom hole 26, of the hub member 14 and, if appropriate, additionally secured therein by means of glue.

When the shell 2 is rotated with respect to the shell 1, the axle 5 which is firmly attached to the shell 2 rotates in the same manner therewith so that, in dependence on the pitch of the thread 32, the separation between the two shells 1, 2 can be increased or decreased without loosening the roller 8. Such a change in separation is advantageous for adjusting the yo-yo for various tricks. In order to prevent the shells 1, 2 from rotating too easily with respect to each other, the support bushing 27 has a ring groove 30 into which an elastic frictional ring 31 is inserted which is pressed between the support bushing 27 and the second hub member 14 in such a fashion that the shells 1, 2 are secured against rotation in response to forces occurring during use of the yo-yo, whereas, when larger adjusting forces are applied, the shells 1, 2, can be rotated to change their axial separation.

Figure 4:
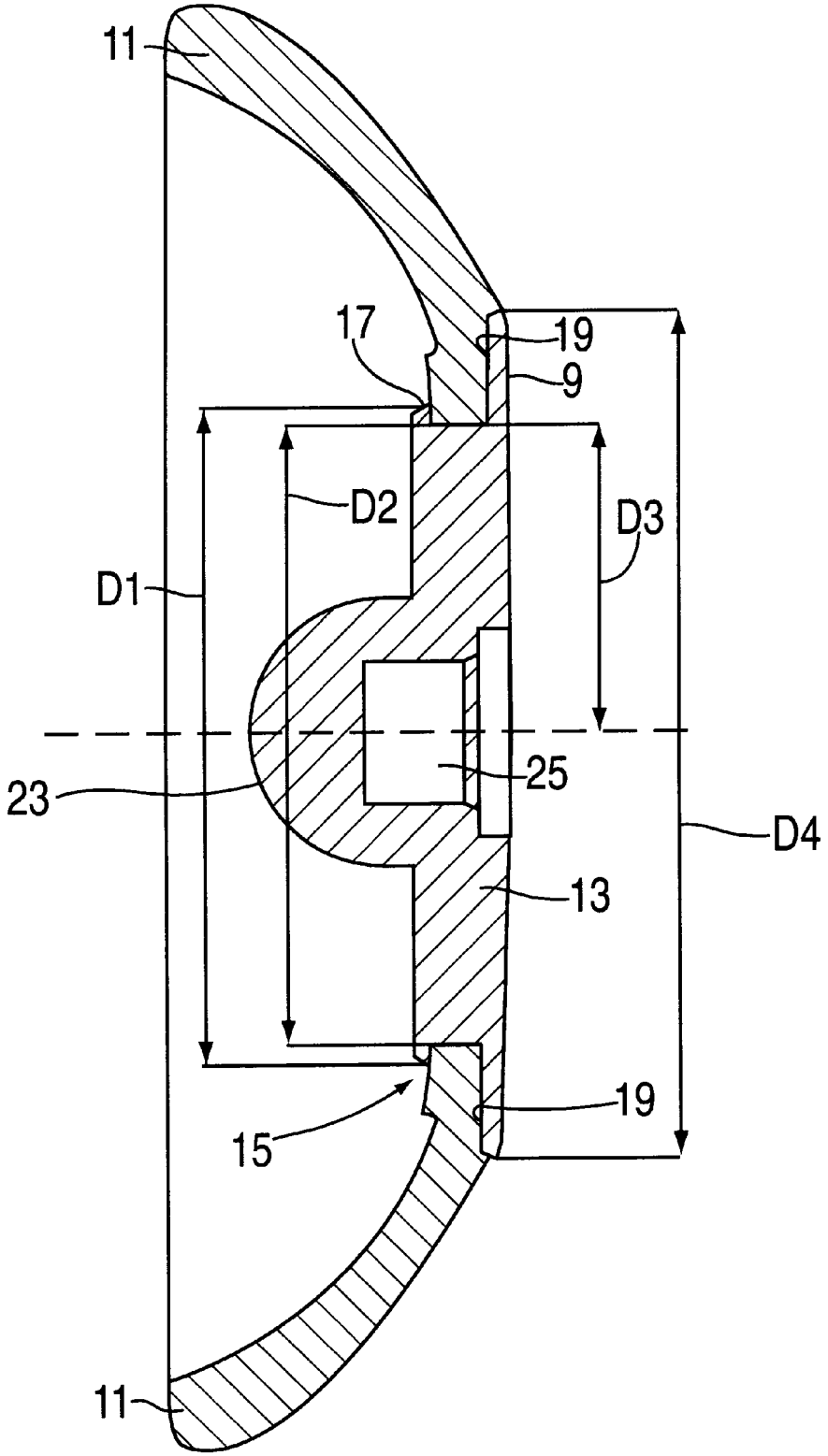
FIG. 4 shows a detail of FIG. 3 in another configuration.

FIG. 4 shows an alternative configuration of shell 1 with which the latch edge 17 is disposed at an increased radial separation D3 from the middle of the axle 5 compared to the shell 1 shown in FIG. 2. The larger this radial separation D3, for a given elasticity of the material of the rotor member 11, the larger the possible difference between the radially outer diameter D1 of the latch connection 15 and the inner diameter D2 of the central opening in the rotor member 11 can be. In other words, the length of the latch edge 17 covering and clamping the rotor member 11 can be larger the further radially outward the latch connection 15 is disposed. Since the frictional forces preventing an undesired rotation of the rotor member 11 relative to the hub member 13 and caused by the clamping of the rotor member 11 between the seating surface 19 and the latching edge 17 increase with larger overlap, an improved securing of the rotor member 11 with respect to rotation is thereby achieved. The radial separation D3 is advantageously more than 10%, preferentially more than 20% and particularly preferentially more than 30% of the maximum outer diameter D4 of the hub member 13.

Figure 5:
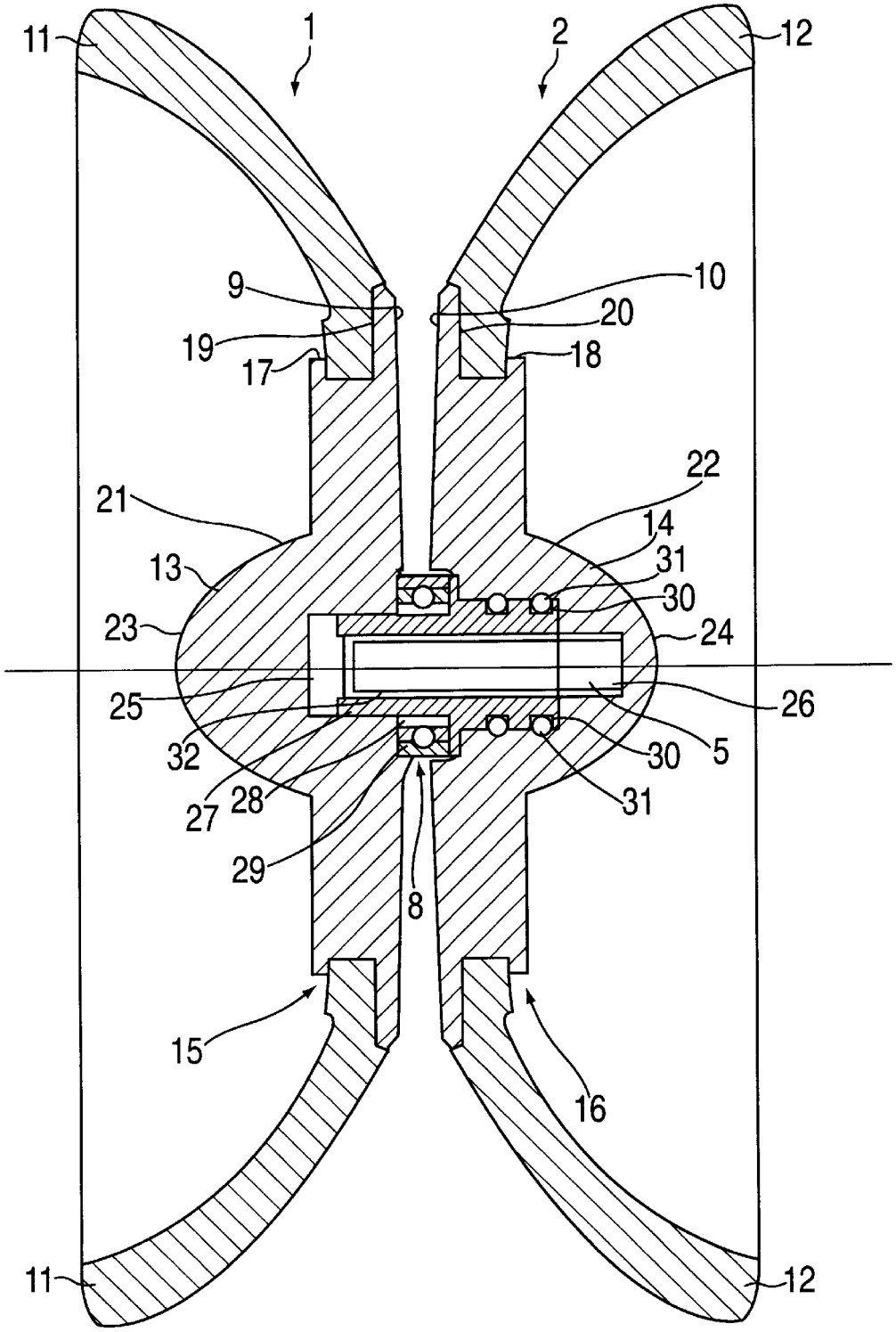
FIG. 5 shows another configuration with respect to FIG. 3.

FIG. 5 shows a yo-yo according to the invention which differs from the yo-yo shown in FIG. 3 by having another shape for the rounded cap 23, 24 as well as, in accordance with FIG. 4, a more outward radial disposition of the latch connection 15, 16 which, in this example, is not tapered towards the axle 5. In addition, in order to achieve a more stable guiding, two friction rings 31 are provided disposed at a separation from each other.

Figure 6:
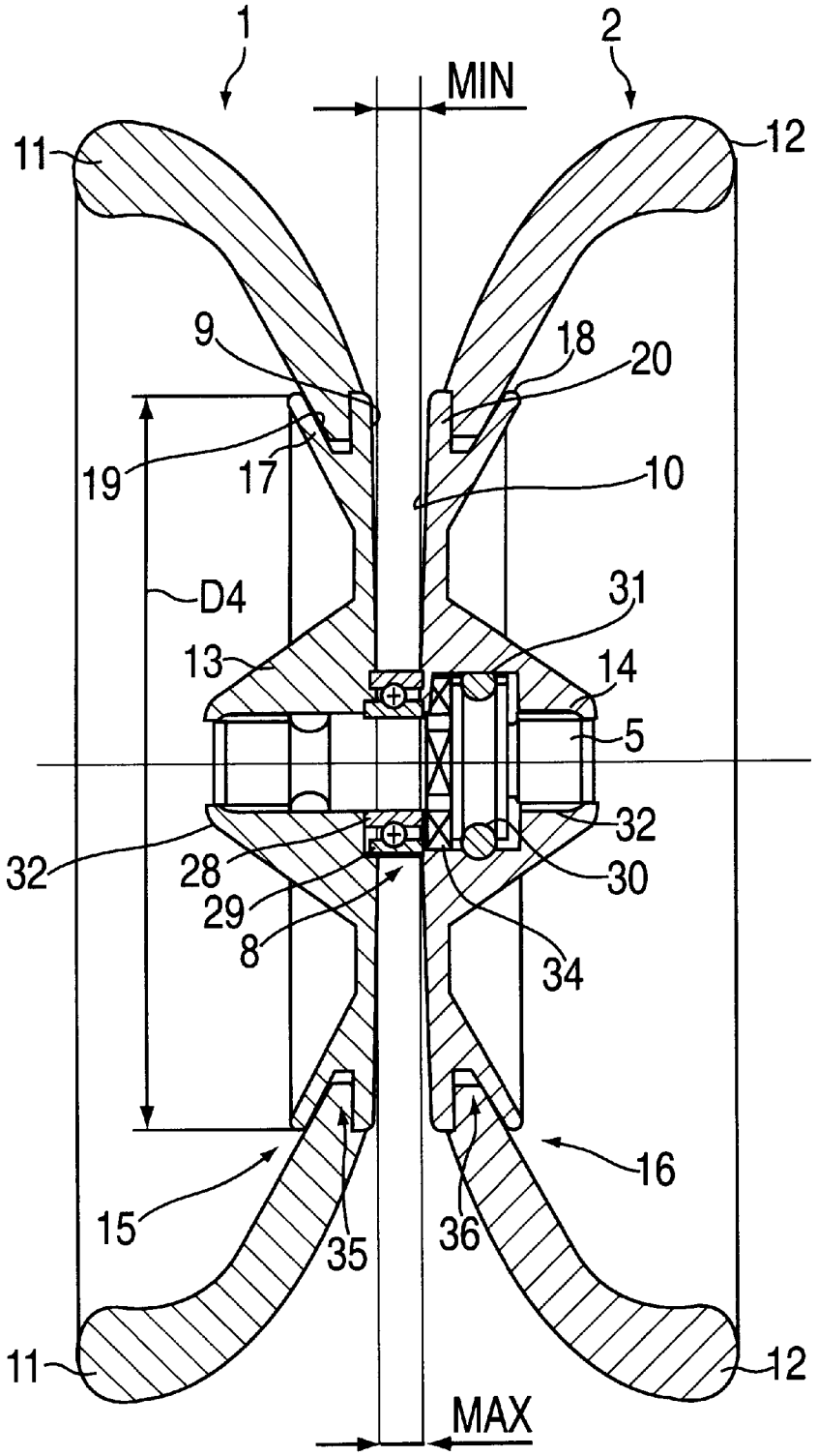
FIG. 6 shows a cross section through a yo-yo with a rotor member which can be flipped over.

FIG. 6 shows a cross section through a yo-yo in accordance with the invention with rotor members 11, 12 which can be flipped over. In the yo-yo shown, the axle 5 is made from one piece and the ends can have depressions, for example an inward hexagonal socket, to simplify assembly. The ends of the axle 5 have a thread 32 which cooperates with the corresponding thread in the hub members 13, 14. The inner ring 28 of the roller 8 is mounted in the first hub member 13 with the assistance of a machined hexagonal section 34 of axle 5. In addition, the axle 5 supports the frictional ring 31 in a ring groove 30 which, by means of a clamping action, hinders rotation of the second hub member 14 within the thread 32 of the other end of the axle 5. The separation between the two shells 1, 2 can be adjusted by rotating the hub member 14. The minimum and maximum separation are designated in FIG. 6 with min and max.

The rotor members 11, 12 have central openings, the edges of which have a trapezoidal shaped cross section. These edges engage in a fan-belt fashion in corresponding grooves 35, 36 of the hub members 13, 14 to, by means of the fan-belt action, increase the friction between the rotor members 11, 12 and the hub members 13, 14 and effect more secure seating of the rotor members 11, 12. The side angles of the trapezoidal edges of the rotor members 11, 12 can be adjusted and optimized over wide ranges so that, when inserting the rotor members 11, 12 into the hub members 13, 14 via the latch connections 15, 16, the desired radial tensioning can be achieved in the rotor members 11, 12 to effect the fan-belt interaction between the edge of the central opening of the rotor members 11, 12 and the hub members 13, 14.

FIGS. 7 through 10 illustrate assembly of the rotor member 11 of FIG. 6 which can be flipped over onto a hub member 13. The rotor member 11 and the hub member 13 are sectioned for reasons of clarity.

Figure 7:
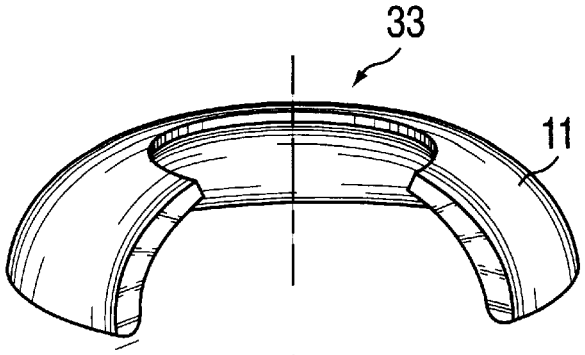
FIGS. 7 through 10 show the assembly of a rotor member which can be flipped over onto a hub member with a groove.
Figure 8:
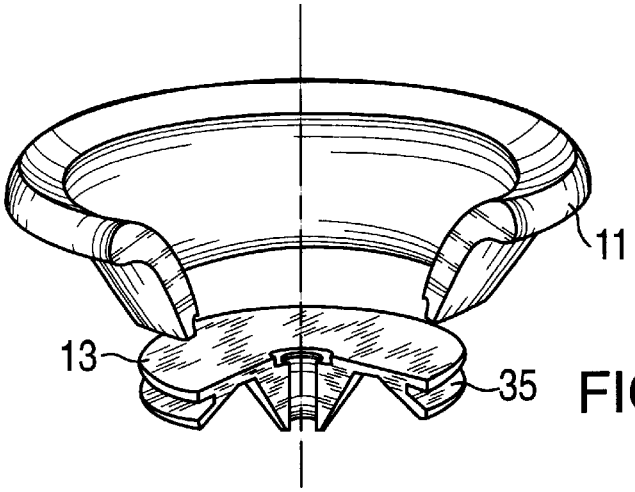
Figure 9:
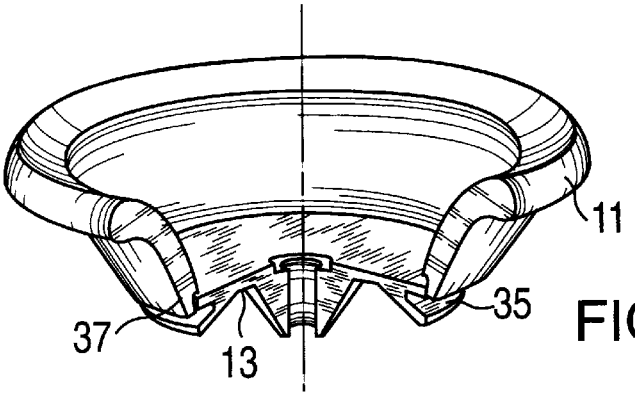

In FIG. 7, the rotor member 11 is shown in the initial shape. It has a central opening 33 the edge of which has a trapezoidal shaped cross section. It consists essentially of a thermoplastic elastomer and can therefore be flipped over out of the concave shape shown and assumed during use into the convex form shown in FIG. 8 for assembly onto the hub member 13. The trapezoidal shaped edge of the central opening 33 is configured in such a fashion that the diameter of the central opening 33 is increased when flipped over. As result of this, the diameter of the central opening 33 in the convex shape in accordance with FIG. 8 is larger than the diameter in the concave shape in accordance with FIG. 7 and is, in particular, larger than the maximum outer diameter D4 (see FIG. 6) of the hub member 13. The rotor member 11 can consequently, as shown in FIG. 9, be placed over the hub member 13. In a somewhat changed but likewise advantageous embodiment, the diameter of the central opening 13 in the convex shape is smaller than the maximum outer diameter D4 of the hub member 13 and can be expanded in such a fashion that the rotor member 11 can be placed onto the hub member 13.

In order to simplify assembly, the edge of the central opening 33 can have a step or a shoulder 37 which seats in the provided position on the hub member 13 to therefore constitute a defined stop. The diameter of the central opening 33 is, in that region which is placed over the hub member 13, nevertheless larger than the maximum outer diameter D4 of the hub member 13.

In order to achieve sufficient clamping of the rotor member 11 onto the hub member 13, the diameter of the central opening 33 in the concave shape is advantageously more than 5%, preferentially more than 10% larger than the diameter in the convex shape. Particularly advantageous are values of 15%.

Figure 10:
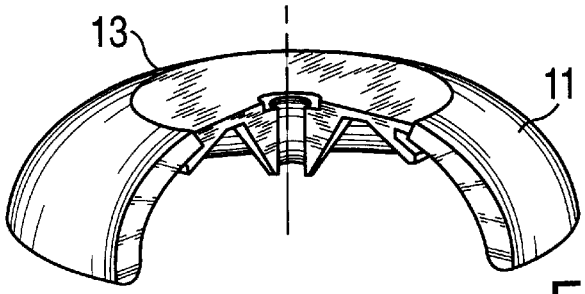

Departing from the shape shown in FIG. 9, the rotor member 11 can, by reverse flipping into the initial shape in accordance with FIG. 7, be flipped over the hub member 13, wherein the trapezoidal shaped edge of the central opening 33 engages into the groove 35 of the hub member 13 to secure the rotor member 11 on the hub member 13 via the resulting clamping (FIG. 10). Advantageously, the diameter of the central opening 33 in the concave shape is smaller than the maximum outer diameter D4 of the hub member 13. The diameter of the central opening 33 in the concave shape is thereby more than 5%, and preferentially more than 10%, smaller than the maximum outer diameter D4 of the hub member 13.

What is claimed is:

1. A climbing top comprising: two shells connected by an axle assembly, wherein at least one of the shells comprises a hub member receiving the axle assembly and a rotor member extending radially outwardly of the hub member with respect to the axle assembly and mounted on the hub member with a direct snap-on connection which prevents axially outward displacement of the rotor member with respect to the hub member, wherein the rotor member is curved concave in the axial direction and has a central opening for attachment onto the hub member and is flexible and elastic in such a fashion that it is flipped over into a convex shape for placement onto the hub member, is placed onto the hub member in the convex shape and, at this location, is mounted onto the hub member by flipping over into the concave shape to form the direct snap-on connection between the hub member and the rotor member at the edge of the central opening.

2. The climbing top according to claim 1, wherein the diameter of the central opening, in the convex shape, is larger than the maximum outer diameter of the hub member.

3. The climbing top according to claim 1, wherein the diameter of the central opening, in the convex shape, is smaller than the maximum outer diameter of the hub member and can be expanded in such a fashion that the rotor member can be placed onto the hub member.

4. The climbing top according to claim 1, wherein the diameter of the central opening, in the concave shape, is smaller than the maximum outer diameter of the hub member.

5. The climbing top according to claim 4, wherein the diameter of the central opening in the concave shape is more than 5% smaller than the maximum outer diameter of the hub member.

6. The climbing top according to claim 1, wherein the diameter of the central opening in the concave shape is more than than 5% larger than the diameter in the convex shape.

7. The climbing top according to claim 1, wherein the edge of the central opening has a trapezoidal shaped cross section and can be inserted in a fan-belt type fashion into a corresponding groove of the hub member.

8. The climbing top according to claim 1, wherein the hub member has a bottom hole or through hole for accepting an axle.

9. The climbing top according to claim 8, wherein an axially outward part of the hub member has a rounded cap shape.

10. The climbing top according to claim 1, wherein the hub member comprises metal or plastic.

11. The climbing top according to claim 10, wherein the hub member comprises a light metal.

12. The climbing top according to claim 1, wherein the rotor member comprises a resilient elastic material having high restoring force, the modulus of elasticity of which lies between 1–500 MPa.

13. The climbing top according to claim 1, wherein the rotor member comprises a material having a low creeping behavior whose modulus of creeping lies between 3 and 300 MPa.

14. The climbing top according to claim 1, wherein the rotor member comprises a material having high friction, the coefficient of friction of which on the material of the hub member is larger than 0.1.

15. The climbing top according to claim 1, wherein the rotor member comprises plastic.

16. The climbing top according to claim 15, wherein the plastic is a thermoplastic elastomer.

17. The climbing top according to claim 1, wherein the rotor member comprises silicon.

18. The climbing top according to claim 1, wherein the climbing top is a yo-yo.

19. The climbing top according to claim 1, wherein the axle assembly comprises a roller borne on an axle and disposed between the shells.

20. A climbing top comprising: two shells connected by an axle assembly, wherein at least one of the shells comprises a hub member receiving the axle assembly and a rotor member extending radially outwardly of the hub member with respect to the axle assembly and mounted on the hub member with a direct snap-on connection which prevents axially outward displacement of the rotor member with respect to the hub member, wherein the shells each have a hub for accepting the axle assembly comprising an axle and a support bushing, wherein one hub is displaceable along an axially extending displacement section axially with respect to the other hub on the support bushing which is stationary with respect to the other hub or on the axle, and at least one frictional element is disposed in the displacement section acting between the displaceable hub and the support bushing or the axle respectively which is pressed between the displaceable hub and the support bushing or the axle respectively in such a fashion that the axial separation of the hubs is secured via the friction element with respect to a change caused by forces occurring during use of the climbing top and the separation can be changed through the exercise of larger adjustment forces.

21. The climbing top according to claim 20, wherein the axial separation of the adjustable hub with respect to the stationary hub can be set by hand without the use of tools.

22. The climbing top according to claim 20, wherein the friction element is a friction ring.

23. The climbing top according to claim 22, wherein the displaceable hub, the support bushing or the axle has a ring groove for accepting the friction ring.

* * * * *